US010920412B2

(12) United States Patent
Hall et al.

(10) Patent No.: US 10,920,412 B2
(45) Date of Patent: Feb. 16, 2021

(54) MODULAR BUILDING UNIT AND SYSTEM

(71) Applicant: Hall Labs, LLC, Provo, UT (US)

(72) Inventors: David R. Hall, Provo, UT (US); Benjamin Jensen, Orem, UT (US); Jonathan Marshall, Provo, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/236,347

(22) Filed: Dec. 29, 2018

(65) Prior Publication Data

US 2020/0208395 A1 Jul. 2, 2020

(51) Int. Cl.
*E04B 1/19* (2006.01)

(52) U.S. Cl.
CPC ..... *E04B 1/19* (2013.01); *E04B 2001/1975* (2013.01); *E04B 2001/1996* (2013.01)

(58) Field of Classification Search
CPC ..... E04B 1/19; E04B 2001/1996; E04B 2001/1975; E04B 1/1903; E04B 2001/1915; E04B 7/105; E04B 2001/3241; E04B 1/5831; E04B 1/34807; E04B 1/34815; E04B 1/3483; E04B 1/34861
See application file for complete search history.

(56) References Cited

U.S. PATENT DOCUMENTS 2,809,074 A * 10/1957 McDonald ..... E04C 3/08 239/209
3,380,209 A * 4/1968 Cheskin ..... E04B 1/24 52/223.6
4,059,931 A * 11/1977 Mongan ..... E04B 1/22 52/79.12
4,694,621 A * 9/1987 Locke ..... E04B 1/3483 52/79.13
5,144,780 A * 9/1992 Gieling ..... E04B 1/5831 135/114
5,556,218 A * 9/1996 Homer ..... E04B 1/5831 403/170
5,735,639 A * 4/1998 Payne ..... B65D 90/18 405/129.57
5,826,384 A * 10/1998 O'Neill ..... E04C 3/08 52/223.9
6,151,850 A * 11/2000 Sorkin ..... E04C 5/08 52/223.1
7,866,098 B2 * 1/2011 Cinnamon ..... H02S 20/23 52/173.3
2006/0067795 A1 * 3/2006 Spearing ..... E21D 21/0073 405/259.4

* cited by examiner

*Primary Examiner* — Jessie T Fibseca

(57) ABSTRACT

A modular building unit is disclosed. The modular building unit includes at least nine elongated frame members, each forming one edge of a prism, which prism has at least three side faces and two end faces, with each end of each frame member being rigidly attached to an end of two other frame members. At least three parallel frame members include a channel running therethrough, which channel is open at both ends and adapted to receive a tensioning cable therethrough, whereby like modular building units can be held together at adjoining end faces by tensioning cables. Modular building systems for combining modular building units using tensioned cables are also disclosed.

20 Claims, 10 Drawing Sheets

MODULAR BUILDING UNIT AND SYSTEM

TECHNICAL FIELD

The disclosure relates to modular building units and systems for combining modular building units to create structures.

BACKGROUND

Manmade structures are ubiquitous. Manmade structures include homes, buildings, factories, skyscrapers, ships, trains, planes, vehicles, spaceships, and much more. It is well understood that structures are purpose built for the use of the structure. Regardless of what the intended use of the structure is, it is well understood that structures and buildings must be built, constructed, or otherwise put together.

The act of building a structure is typically an expensive proposition due to the cost of materials, the cost of labor, and the time required to complete construction. Over time, improvements in materials and improvements in construction techniques have enabled bigger and/or taller structures and reduced construction times. Even with such improvements, the act of building a structure continues to be an expensive proposition due to the cost of materials, the cost of labor, and the time required to complete constructions. Further improvements in building materials and construction techniques would be very beneficial.

SUMMARY

In a first aspect, a modular building unit includes at least nine elongated frame members, each forming one edge of a prism, which prism has at least three side faces and two end faces, with each end of each frame member being rigidly attached to an end of two other frame members, where at least three parallel frame members comprise a channel running therethrough, which channel is open at both ends and adapted to receive a tensioning cable therethrough, whereby like modular building units can be held together at adjoining end faces by tensioning cables.

In a second aspect, the modular building unit includes twelve frame members, where the prism is a rectangular prism, with four side faces and where four parallel frame members comprise a channel running therethrough.

In a third aspect, the modular building unit includes eighteen frame members, where the prism is a hexagonal prism, with six side faces.

In a fourth aspect, at least two of the elongated frame members which are orthogonal to the four parallel frame members, also comprise a channel running therethrough, which channel is open at both ends and is adapted to receiving a tensioning cable, whereby like modular building units can be held together at one or more of the end faces and one or two of the side faces by tensioning cables running through the appropriate channels.

In a fifth aspect, all of the frame members include a channel running therethrough, which channel is open at both ends and adapted to receive a tensioning cable therethrough, whereby like modular building units can be held together at one or more of the end faces and one or more of the side faces by tensioning cables running through the appropriate channels.

In a sixth aspect, at least three parallel frame members are adapted to receive a spanning member within each end, a portion of which spanning member is adapted to be received within one channel in the modular building unit and another portion which is adapted to be received within a channel of an adjoined modular building unit.

In a seventh aspect, each channel includes a stop member protruding from an interior surface to thereby prevent a spanning member from being inserted too deep into the channel.

In an eighth aspect, a modular building system includes a first building unit comprising at least nine elongated frame members, each forming one edge of a prism, which prism has at least three side faces and two end faces, with each end of each frame member being rigidly attached to an end of two other frame members, where at least three parallel frame members comprise a channel running therethrough, which channel is open at both ends; a second building unit comprising at least nine elongated frame members, each forming one edge of a prism, which prism has at least three side faces and two end faces, with each end of each frame member being rigidly attached to an end of two other frame members, where at least three parallel frame members comprise a channel running therethrough, which channel is open at both ends; where one end face of the first building unit is adjoined to one end face of the second building unit, thereby aligning the channels of the first building unit with the channels of the second building unit; at least three cables, each having first and second ends and each passing through one of the channels of the first building unit and through the aligned channel of the second building unit; first keepers coupled to the first end of each cable; and second keepers coupled to the second end of each cable; where the first keepers and the second keepers are adapted to tension the first cable such that the first building unit and the second building unit are joined together to form a rigid structure.

In a ninth aspect, the first and second building units each comprise twelve frame members, wherein the prism of each of the first and second building units is a rectangular prism, and wherein four parallel frame members of each of the first and second building units each comprise a channel running therethrough.

In a tenth aspect, The modular building system further includes a third building unit comprising at least nine elongate frame members, each forming one edge of a prism, which prism has at least three side faces and two end faces, with each end of each frame member being rigidly attached to an end of two other frame members, wherein at least three parallel frame members comprise a channel running therethrough, which channel is open at both ends; wherein one end face of the third building unit is adjoined to an end face of the second building unit that is not adjoined to an end face of the first building unit, thereby aligning the channels of the third building unit with the channels of the second building unit and the channels of the first building unit, and wherein the at least three cables pass through channels in the first building unit, the second building unit and the third building unit and, when tensioned by the first keepers and the second keepers, the first building unite, the second building unit and the third building unit are joined together to form a rigid structure.

In an eleventh aspect, the first, second and third building units each comprise twelve frame members, wherein the prism of each of the first second and third building units is a rectangular prism, and wherein four parallel frame members of each of the first, second and third building units each comprise a channel running therethrough.

In a twelfth aspect, the modular building system further includes spanning members inserted into the ends of aligned channels.

In a thirteenth aspect, each channel comprises a stop member protruding from an interior surface to prevent a spanning member from being inserted too deep into the channel.

In a fourteenth aspect, each spanning member comprises a stop member protruding from an outer surface of the spanning member to prevent a spanning member from being inserted too deep into the channel.

In a fifteenth aspect, each spanner comprises a channel for a cable to pass through.

In a sixteenth aspect, a modular building system includes a plurality of building units, each comprising twelve elongated frame members, each forming one edge of a rectangular prism, which rectangular prism has six faces, with each end of each frame member being rigidly attached to an end of two other frame members, wherein all of the twelve frame members comprise a channel running therethrough, which channel is open at both ends; a plurality of cables, each with a first and second keeper; wherein building units can be rigidly joined together by adjoining faces, aligning channels, passing cables through the aligned channels and pulling a tension on the cables to thereby press the adjoined faces together.

In a seventeenth aspect, a first and second building unit are rigidly joined together in a first direction and wherein at least a third building unit is rigidly joined to the first building unit in a second direction which orthogonal to the first direction.

In an eighteenth aspect, at least a fourth building unit is rigidly joined to the first building unit in a third direction which is orthogonal to the first and second direction.

In a nineteenth aspect, the modular building system further includes spanning members inserted into the ends of aligned channels.

In a twentieth aspect, each spanning member comprising a channel for a cable to pass through.

In a twenty first aspect, a modular building unit is disclosed. The modular building unit includes a plurality of elongated frame members. A first elongated frame member of the plurality of elongated frame members includes a primary channel that extends through the first elongated frame member along a longitudinal axis of the first elongated frame member, the primary channel forming a set of primary orifices, one at each end of the first elongated frame member, and where the primary channel includes at least one stop member that protrudes from an interior surface of the primary channel.

In a twenty second aspect, the plurality of elongated frame members include a second elongated frame member that includes primary channel that extends through the second elongated frame member along a longitudinal axis of the second elongated frame member, the primary channel forming a set of primary orifices, one at each end of the second elongated frame member.

In a twenty third aspect, the primary channel that extends through the second elongated frame member is parallel to the primary channel that extends through the first elongated frame member.

In a twenty fourth aspect, the first elongated frame member includes a secondary channel that extends through the first elongated frame member along a lateral axis of the first elongated frame member, where the lateral axis is orthogonal to the longitudinal axis, the secondary channel forming a set of secondary orifices, on two opposing sides of the first elongated frame member, and where the second elongated frame member is fixedly attached to the first elongated frame member such that the primary channel of the second elongated frame member is aligned with the secondary channel of the first elongated frame member.

In a twenty fifth aspect, the first elongated frame member includes a tertiary channel that extends through the first elongated frame member along a vertical axis of the first elongated frame member, where the vertical axis is orthogonal to both a lateral axis and to the longitudinal axis of the first elongated frame member, the tertiary channel forming a set of tertiary orifices, on two opposing sides of the first elongated frame member, and where the second elongated frame member is fixedly attached to the first elongated frame member such that the primary channel of the second elongated frame member is aligned with the tertiary channel of the first elongated frame member.

In a twenty sixth aspect, the primary channel of the second elongated frame member includes at least one stop member coupled to an interior surface of the primary channel of the second elongated frame member.

In a twenty seventh aspect, the at least one stop member is positioned in the range of 0.75 inches to 6 inches from one of the primary orifices.

In a twenty eighth aspect, the plurality of elongated frame members are fixedly attached to each other to form a triangular prism having six vertices.

In a twenty ninth aspect, the plurality of elongated frame members are fixedly attached to each other to form a rectangular prism having eight vertices.

In a thirtieth aspect, each of the plurality of elongated frame members comprise a primary channel that extends through the elongated frame member along a longitudinal axis of the elongated frame member.

In a thirty first aspect, a modular building system is disclosed. The modular building system includes a first building unit having a plurality of elongated frame members, where a first elongated frame member of the plurality of elongated frame members includes a channel that extends through the first elongated frame member along a longitudinal axis of the first elongated frame member, the channel forming a set of orifices, one at each end of the first elongated frame member; a second building unit having a plurality of elongated frame members, where a first elongated frame member of the plurality of elongated frame members includes a channel that extends through the first elongated frame member along a longitudinal axis of the first elongated frame member, the channel forming a set of orifices, one at each end of the first elongated frame member; a first cable that passes through the channel in the first elongated frame member of the first building unit and the channel in the first elongated frame member of second building unit, the first cable having a first end and a second end; a first keeper coupled to the first elongated frame member of the first building unit and coupled to the first end of the first cable; and a second keeper coupled to the first elongated frame member of the second building unit and coupled to the second end of the first cable, where the first keeper and the second keeper are adapted to tension the first cable such that the first building unit and the second building unit are affixed together to form a unified structure.

In a thirty second aspect, the modular building system includes a spanner for aligning two adjacent orifices associated with two adjacent channels from two adjacent building units, where the spanner includes a first portion that is adapted to fit within one of the two adjacent channels and a second portion that is adapted to fit within the other of the two adjacent channels, and where the spanner comprises a pass through channel for connecting the two adjacent channels such that the first cable may pass through the two adjacent channels and through the spanner via the pass through channel.

In a thirty third aspect, each of the two adjacent channels includes a stop member that protrudes from an interior surface of the channel to prevent the spanner from extending too far into the channel.

In a thirty fourth aspect, the spanner includes a stop member that protrudes from the spanner between the first portion and the second portion to prevent the spanner from extending too far into either channel of the two adjacent channels, and where at least a portion of the stop member exceeds a size of each of the two adjacent orifices.

In a thirty fifth aspect, the first building unit and the second building unit are affixed together without any intervening building units, such that the first building unit is adjacent to the second building unit in the unified structure.

In a thirty sixth aspect, the first building unit and the second building unit are affixed together via at least one intervening building units, such that the first building unit is adjacent to an intervening building unit of the at least one intervening building units in the unified structure, and where the first cable passes through a channel in each of the at least one intervening building units.

In a thirty seventh aspect, the modular building system includes a second cable, where the first building unit includes a second elongated frame member of the plurality of elongated frame members, wherein the second elongated frame member of the first building unit includes a channel that extends through the second elongated frame member along a longitudinal axis of the second elongated frame member, where the second building unit includes a second elongated frame member of the plurality of elongated frame members, where the second elongated frame member of the second building unit includes a channel that extends through the second elongated frame member along a longitudinal axis of the second elongated frame member, and where the second cable passes through the channel in the second elongated frame member of the first building unit and the channel in the second elongated frame member of the second building unit, the second cable having a first end and a second end; a third keeper coupled to the first building unit and coupled to the first end of the second cable; and a fourth keeper coupled to the second building unit and coupled to the second end of the second cable, where the third keeper and the fourth keeper are adapted to tension the second cable such that the first building unit and the second building unit are affixed together to form the unified structure.

In a thirty eighth aspect, the first elongated frame member of the first building unit is parallel with the second elongated frame member of the first building unit, where the first elongated frame member of the second building unit is parallel with the second elongated frame member of the second building unit.

In a thirty ninth aspect, the first building unit includes a third elongated frame member and a fourth elongated frame member of the plurality of elongated frame members, where each of the third elongated frame member and the fourth elongated frame member of the first building unit includes a channel that extends through the elongated frame member along a longitudinal axis of the elongated frame member, where the third elongated frame member is orthogonal to the first elongated frame member, and where the fourth elongated frame member is orthogonal to both the first elongated frame member and to the third elongated frame member.

In a fortieth aspect, a first elongated frame member of the first building unit includes a secondary channel and a tertiary channel, where the secondary channel extends through the first elongated frame member along a lateral axis of the first elongated frame member, the secondary channel forming a set of orifices on opposite sides of the first elongated frame member, where the tertiary channel extends through the first elongated frame member along vertical axis of the first elongated frame member, the tertiary channel forming a set of orifices on opposite sides of the first elongated frame member, and wherein each of the channel, secondary channel, and tertiary channel of the first elongated frame member are non-overlapping.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
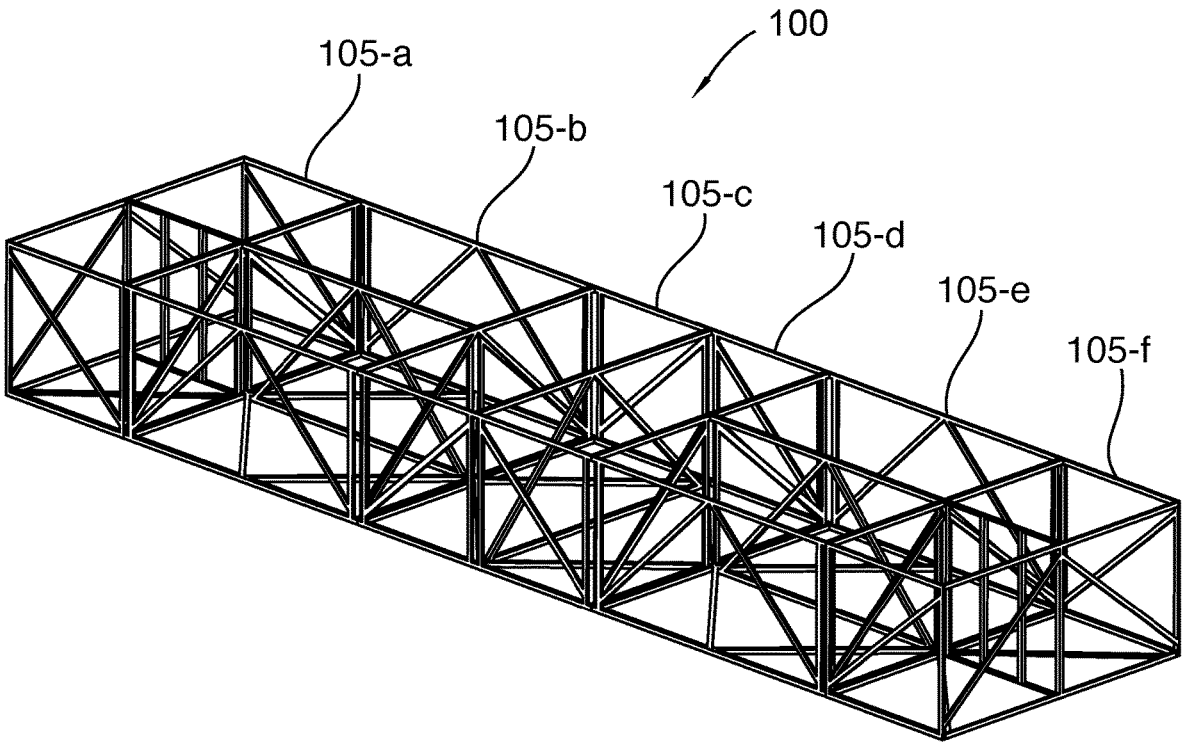
FIG. 1 is a perspective diagram illustrating one example of a unified structure that is formed from using multiple modular building units.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

DEFINITIONS

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a component" encompasses a single component as well as two or more components, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

The present disclosure is directed to a modular building unit and systems and methods for combining modular building units to form structures. Although, the examples described herein relate to structures that are occupiable, such as tiny homes, homes, condos, apartment buildings, corporate buildings, office buildings, warehouses, skyscrapers, and the like, it is understood that the present disclosure may also be applied to other structures, including recreational vehicles, travel trailers, boats, trains, planes, spacecraft, extraterrestrial communities, and the like.

One of the challenges with traditional building techniques is that much of the construction happens onsite. Efforts have been made to move portions of construction activities offsite. One example of this is the use of pre-cast concrete. Another example of this is the use of steel fabrication. However, often, as in the case of both of these examples, the result of these offsite activities are extremely heavy components that are difficult to handle and work with. The present disclosure overcomes many of the challenges associated with current building materials and current construction methods. In addition, the present disclosure provides improved benefits and functionality over current building materials and construction methods.

As described herein the present disclosure is directed to a modular building unit as well as a construction system and method for combining multiple modular building units into structures. It is appreciated that the modular building units may be combined along the longitudinal axis, the lateral axis, and/or the vertical axis to form any of a variety of unique structures. Depending on the shape of the modular building units (e.g., triangular, octangular, etc.) and/or to provide additional strength and structural integrity, the modular building units may be combined on any axes (e.g., 30 degrees, 45 degrees, 60 degrees, and the like) where at least two modular building units have corresponding channels that aligned to be tensioned with a tensioning cable. It is further appreciated that the modular building units may be combined to form bridges, overhangs, suspended sections, and the like.

The described modular building units may be any prismatic structure. Preferably the modular building unit may be rectangular prism or cuboid. The examples described herein relate to rectangular prism structures. However, the principles described herein may be applied to triangular prisms, hexagonal prisms, octagonal prisms, and the like. It is appreciated that the axes associated with each of the different prismatic structures may vary from the axes associated with the rectangular prim, without departing from the scope of the disclosure.

The modular building units may be made up of multiple elongated frame members (e.g., frame members having an elongated structure) that are coupled together to form a prismatic structure. In one example the elongated frame members may be made of tubular pipe. The tubular pipe may be square pipe, rectangular pipe, circular pipe, and the like. In some embodiments, the tubular pipe may be made of high strength, corrosion resistant, metals (e.g., stainless steel, stainless steel 304, and the like). In addition to the elongated frame members, modular building units may include additional supports. In some cases, the additional supports may increase the structural integrity of the prismatic structure to ensure that the prismatic structure maintains it shape and weight bearing capabilities while under high stress loads, including high compression loads.

One or more of the elongated frame members may include a channel that extends across and forms a set of orifices on opposite sides of the elongated frame member. In the simplest case, the elongated frame member may be made of tubular pipe and the tubular pipe itself provides the channel that extends through and forms an orifice on each end. In another case, the elongated frame member may include multiple tubular pipes, with each tubular pipe forming a separate channel. In yet another case, an elongated frame member that is made of a single tubular pipe may provide multiple channels, by drilling one or more holes through the single tubular pipe. It is appreciated that the holes may be made in any orientation but may correspond with three different orthogonal axes (such as the longitudinal axis, the lateral axis, and the vertical axis of the elongated frame member).

As disclosed herein, two or more modular building units may be coupled together to form a unified structure by passing a cable through corresponding channels in each of the modular building units and tensioning the cable such that the tensioned cable affixes the two or more modular building units into a single unified structure. In some cases, multiple cables may be used to ensure that the two or more modular building units are affixed together into a unified structure regardless of the loads and stresses placed upon the unified structure. For example, at least three and preferably four cables, one at each corner, may be used to affix the two or more modular building units together into a unified structure. It is appreciated that modular building units tensioned together using four cables (one at each corner, for example) forms a rigid structure that can bear substantial external loads. For example, the rigid structure may be used to form a bridge that is only supported on the ends, elevated floors and/or ceilings of a building that are only supported at the ends, multi-story apartment buildings, skyscrapers, and the like).

This process of combining modular building units through the use of tensioned cables may be repeated in each axis that the prismatic structures includes a corresponding channel. For example, a set of cables (e.g., 4 cables) may be used to affix two or more modular building units along a longitudinal axis, a set of cables (e.g., 4 cables) may be used to affix two or more modular building units along a lateral axis, and a set of cables (e.g., 4 cables) may be used to affix two or more modular building units along a vertical axis. It is appreciated that with three degrees of freedom and universal modular building units that may be combined in any orientation (assuming corresponding channels, for example) that there are potentially millions of different configurations and therefore unified structures that may be formed using the described devices, systems, and methods.

In one example, an entire building (e.g., multi-story apartment building) may be built using modular building units that are tensioned together into a single rigid structure. In such an example, the building may be finished by facing the exterior of the single rigid structure with aesthetically pleasing materials (e.g., glass, stone, brick, etc.) and topping the single rigid structure with a roof.

With the ability to use modular building units to build entire buildings, it is appreciated that the construction of modular building units may be optimized for mass production. For example, the entire modular building unit may be built using precision cut (using a fiber laser, for example) tubular pipe that is laser welded (without the use of stick feed, for example), such that the tubular pipe itself (e.g., elongated frame member) forms the appropriate channels. In some cases, the modular building units may be precisely jigged, and laser welded by robots. For the case where two tubular pipes are welded together, such that one of the tubular pipes blocks the channel of the other tubular pipe, a hole may be drilled or milled into the blocking tubular pipe so that the channel of the other tubular pipe may be accessible through the hole. It is appreciated that such holes may be offset to ensure that both channels may be used simultaneously without interference between different tensioning cables.

As described herein, complex structures may be quickly and efficiently constructed using modular building units and tensioned cables. These features and additional features associated with this disclosure are illustrated and discussed with reference to the Figures.

FIG. 1 is a perspective diagram illustrating one example of a unified structure 100 that is formed from using multiple modular building units 105. The unified structure 100 includes a first modular building unit 105-*a*, a second modular building unit 105-*b*, a third modular building unit 105-*c*, a fourth modular building unit 105-*d*, a fifth modular building unit 105-*e*, and a sixth modular building unit 105-*f*. In some cases, as shown, modular building units 105 may be different sizes. For example, the first modular building unit 105-*a*, the third modular building unit 105-*c*, the fourth modular building unit 105-*d*, and the sixth modular building unit 105-*f* may be a first size (e.g., 4'×8'×4') while the second modular building unit 105-*b* and the fifth modular building unit 105-*e* may be a second size (e.g., 8'×8'×4').

Although not shown, each of the modular building units 105-*a*-*f* are coupled together using tensioned cables to form the unified structure 100. For example, four parallel tensioned cables (not shown, one at each corner, for example) may extend through corresponding channels in each of the modular building units 105-*a*-*f* along the length of the unified structure 100. In this way the tensioned cables compress and affix each of the modular building units 105-*a*-*f* together so that the affixed modular building units 105-*a*-*f* form the unified structure 100.

With the tensioned cables affixing the modular building units 105-*a*-*f* together into a unified structure 100, the unified structure 100 may be suspended and/or may span across a gap because of the structural integrity provided by the combination of modular building units 105-*a*-*f* and the tensioned cables. It is appreciated that the combination of placing modular building units 105 in place and forming unified structures (e.g., unified structure 100) by tensioning cables that extend through corresponding channels in the modular building units 105, significantly reduces construction time associated with building a unified structure and increases the structural integrity of a unified structure.

Using tensioned cables to affix modular building units 105 together provides substantial time savings over alternative attachment techniques, such as welding individual modular building units 105 together or pinning individual modular building units 105 together. In addition, using tensioned cables to affix modular building units 105 together provides substantial structural integrity to the unified structure 100 over alternative attachment techniques, such as pinning individual modular building units 105 together.

In some embodiments, each of the modular building units 105 may be a prismatic structure that includes usable space within the prismatic structure. For example, the first modular building unit 105-*a* and the sixth modular building unit 105-*f* may each include two usable areas (e.g., 4'×4'×4'), the third modular building unit 105-*c* and the fourth modular building unit 105-*d* may each include one usable area (e.g., 4'×8'×4'), and the second modular building unit 105-*b* and the fifth modular building unit 105-*e* may each include two usable areas (e.g., 4'×8'×4'). Although the modular building units 105 are shown in a particular combination, it is appreciated that various combinations are possible, and the shown combination is only one example of a possible combination. For instance, the fifth modular building unit 105-*e* may be replaced with any combination of the first modular building unit 105-*a* and the third modular building unit 105-*c*, or may be removed completely.

The usable space within the modular building unit 105 in combination with the way each modular building unit 105 is constructed (with elongated frame members and additional supports, for example) enable the modular building units 105 to be lighter weight while maintaining structural strength than comparable building materials (e.g., cement, metal work, lumber, etc.). In addition, by their nature and construction, modular building units 105 are in an easily manageable form factor, for easy manufacture (e.g., offsite manufacture), easy transportation, easy maneuverability, and easy positioning.

Figure 2:
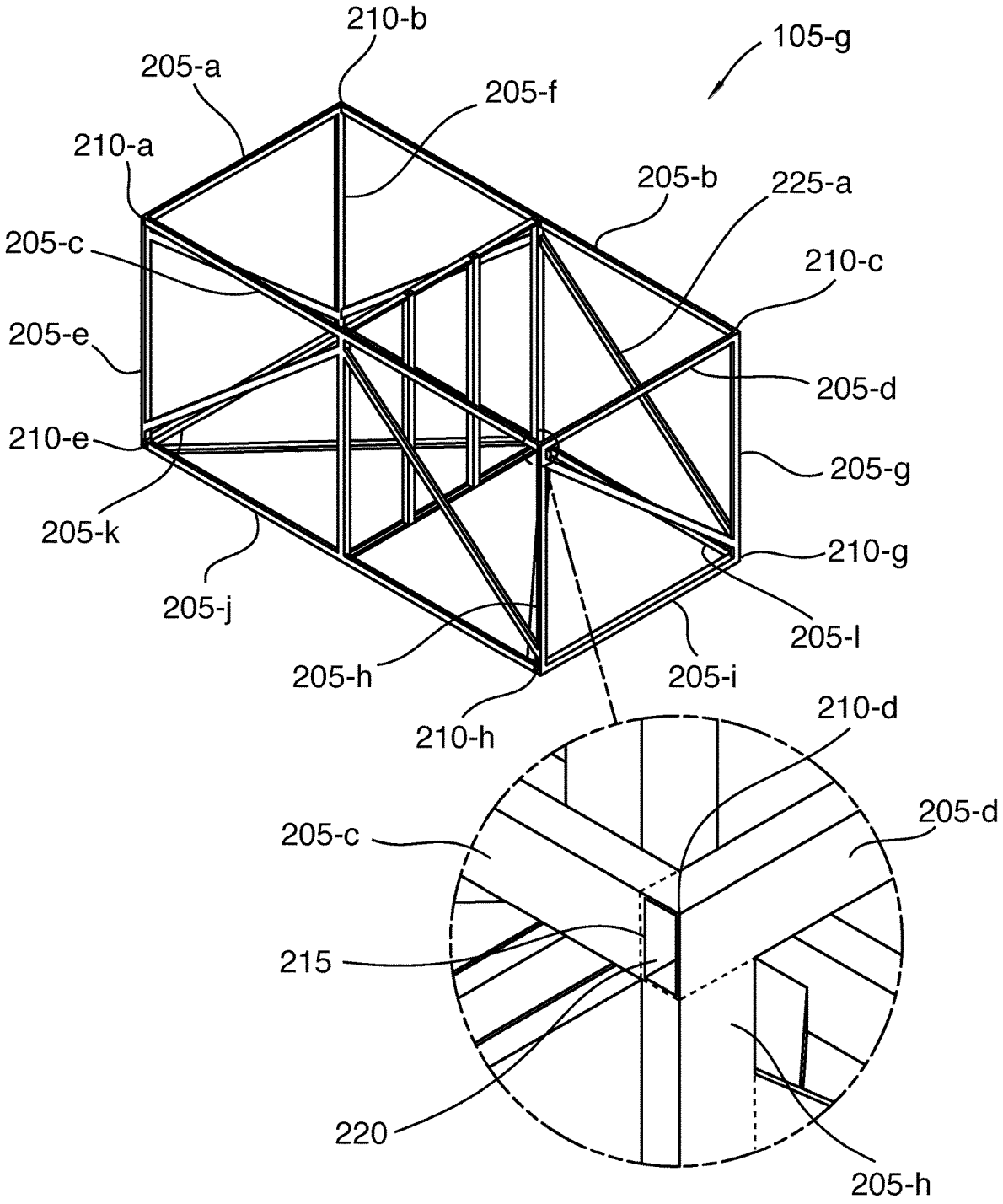
FIG. 2 is a perspective diagram illustrating one example of a modular building unit.

FIG. 2 is a perspective diagram illustrating one example of a modular building unit 105-*g*. The modular building unit 105-*g* is an example of the modular building units 105 discussed in FIG. 1. In particular, the modular building unit 105-*g* is an example of the first and sixth modular building units 105-*a*, 105-*f*.

The modular building unit 105-*g* includes multiple elongated frame members 205-*a*-*l*. As shown, the modular building unit 105-*g* may be a rectangular prism with a rectangular top defined by elongated frame members 205-*a*-*d*, a rectangular bottom defined by elongated frame members 205-*i*-*l*, and a height defined by elongated frame members 205-*e*-*h*. The modular building unit 105-*g* includes eight vertices 210-*a*-*h* at the connection points of the elongated frame members 205-*a*-*l*. The modular building unit 105-*g* includes one or more additional supports (e.g., additional support 225-*a*) as shown to ensure the structural integrity of the modular building unit 105-*g* for both load bearing and for compression strength (to maintain shape and structural integrity when tensioned by tensioned cables, for example).

At least one of the elongated frame members 205 (e.g., elongated frame member 205-*d*) includes a channel 220 that extends through the elongated frame member 205 along a longitudinal axis of the elongated frame member 205. As shown, elongated frame member 205-*d* includes a channel 200 that extends through the elongated frame member 205-*d* along the longitudinal axis of the elongated frame member 205-*d* and is open at both ends (e.g., orifice 215). For example, the channel 200 forms an orifice (e.g., orifice 215)) on opposing sides (e.g., opposing ends) of the elongated frame member 205-*d*. In some embodiments, as shown, the elongated frame member 205-*d* may be tubular pipe (e.g., rectangular tubular pipe) and the tubular pipe itself provides the channel 220 along the longitudinal axis of the elongated frame member 205-*d*. In some embodiments, the channel 220 extends from vertex 210-*c* to vertex 210-*d*. Although, only one of the elongated frame members 205 (i.e., elongated frame member 205-*d*) is shown as having a channel 220, it is understood that one or more of the other elongated frame members may include one or more channel(s). For example, one, some, or all of the elongated frame members 205-*a*, 205-*d*, 205-*k*, and 205-*l* may include a channel (e.g., channel 220) so that the modular building unit 105-*g* may be combined with other modular building units 105 along a lateral axis of the modular building unit 105-*g* using one (1) to four (4) tensioned cables (so it could be added to unified structure 100 as described with respect to FIG. 1, for example).

Additionally or alternatively, one, some, or all of the elongated frame members 205-*b*, 205-*c*, 205-*l*, and 205-*j* may include a channel (e.g., channel 220) so that the modular building unit 105-*g* may be combined with other modular building units 105-*g* along a longitudinal axis of the modular building unit 105-*g*.

Additionally or alternatively, one, some, or all of the elongated frame members 205-*e*, 205-*f*, 205-*g*, and 205-*h* may include a channel (e.g., channel 220) so that the modular building unit 105-*g* may be combined with other modular building units 105-*g* along a vertical axis of the modular building unit 105-*g*.

In some embodiments, the additional structural supports (e.g., additional support 225-*a*) may be elongated metal bars. In other embodiments, one or more of the additional structural supports may also be elongated frame members (e.g., frame members 205) that include a channel for being combined (using tensioned cables as discussed herein, for example) along additional axes (along a 45-degree angle, for example). It is appreciated that combining along additional axes further improves the structural integrity of the single rigid structure (e.g., structure 100).

It is understood that the prismatic structure of a modular building unit (e.g., modular building unit 105-*g*) provides substantial space within the prismatic structure that may be opportunistically used. For example, the modular building unit 105-*g* includes two cubes of space (e.g., approximately 4'×4'×4' of usable space within the prismatic structure). In one example, this space may be used to store items.

For example, a lifting system may be integrated into the modular building unit 105-*g* to lift/retract a storable unit or other objects in or out of the modular building unit 105-*g*. For instance, the storable unit may have a top that aligns with the planar surface of the modular building unit 105-*g* when recessed and a subfloor that aligns with the planar surface of the modular building unit 105-*g* when the storable unit is lifted. This storable unit may allow for free storage with the storable unit. Additionally or alternatively, the storable unit may hold an appliance (e.g., a washer and/or dryer) that may be lifted when needed and stowed out of the way within the modular building unit 105-*g* when not needed. In another embodiment, the lifting system may allow for similar storage from above (where objects descend and arise, for example) when the modular building unit 105-*g* is in the ceiling. It is appreciated that modular building units (e.g., modular building unit 105-*g*) may be adapted for different uses. Such adaptations may include mounting plates and/or holes, wiring holes, lifting mechanisms, etc.

Figure 3:
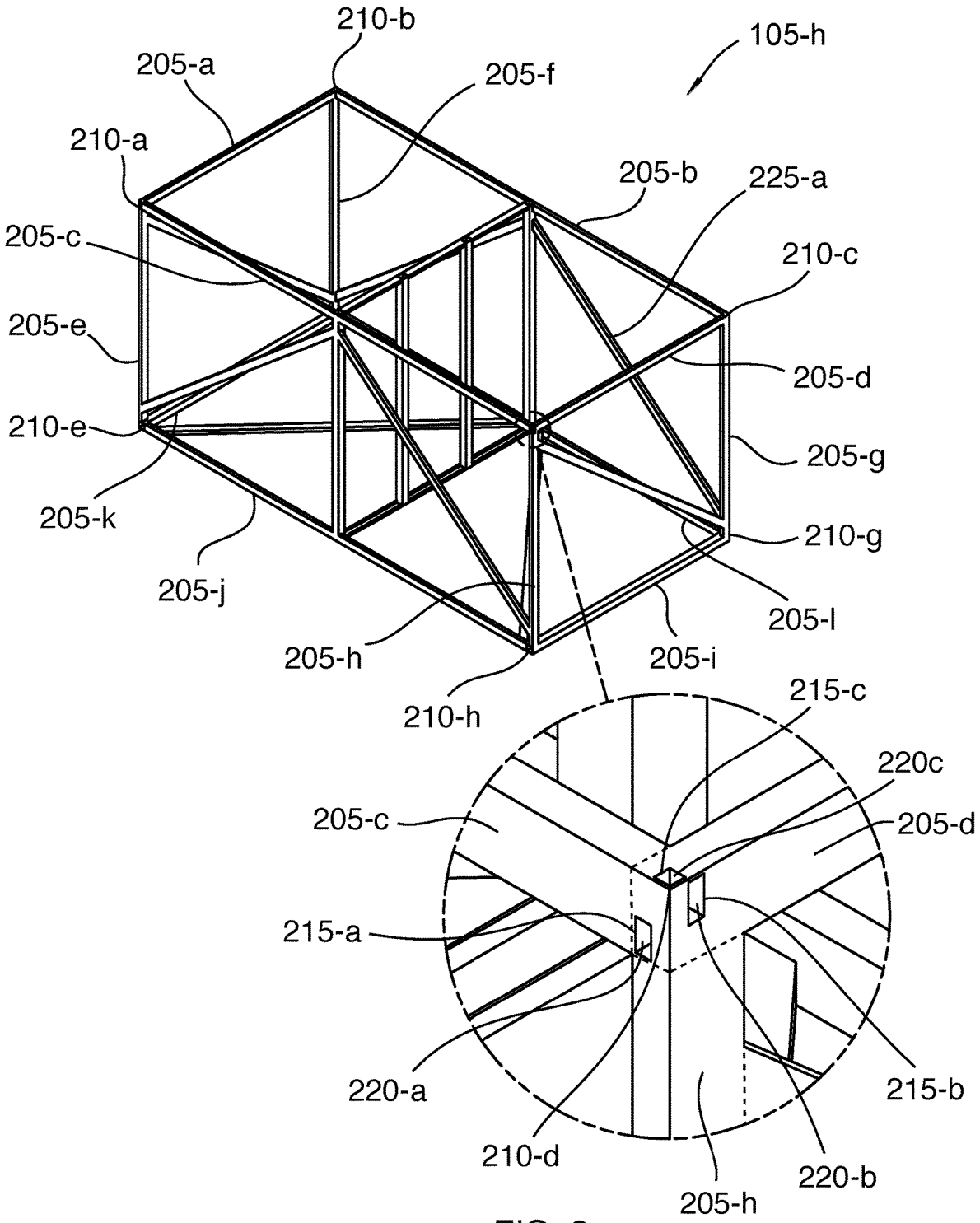
FIG. 3 is a perspective diagram illustrating another example of a modular building unit.

FIG. 3 is a perspective diagram illustrating another example of a modular building unit 105-*h*. The modular building unit 105-*h* is an example of the modular building unit 105-*g* and includes elongated frame members 205, vertices 210, and additional supports as described with respect to FIG. 2. The elongated frame members 205 are similar to the elongated frame members 205 described with respect to FIG. 2, except that instead of having only a single channel 220 that extends in along a longitudinal axis of the elongated frame member 205, the elongated frame members 205 of the modular building unit 105-*h* may include multiples channels that extend in the same or different directions (parallel to the same axis, on different axes, and/or along different orthogonal axes, for example).

For example, as shown in the enlarged section around vertex 210-*d*, elongated frame members 205-*c*, 205-*d*, and 205-*h* may each include a primary channel (e.g., channel 220) that extends along a longitudinal axis of the elongated frame member 205. As shown, elongated frame member 205-*d* includes a primary channel 220-*a* that extends along the longitudinal axis of the elongated frame member 205-*d*. As shown, the primary channel 220-*a* is accessible via orifice 215-*a*.

In some embodiments, the channel 220 itself forms the orifice 215 such that the orifice 215 and the channel 220 are the same size. In other embodiments, the channel 220 may be larger than the orifice 215 that supplies the channel 220. For example, the primary channel (e.g., channel 220) that extends along the longitudinal axis of the elongated frame member 205 may be formed by the tubular pipe that substantially makes up the elongated frame member 205. For instance, even in this example, where each of the orifices 215-*a*, 215-*b*, 215-*c* are smaller than the interior size of the tubular pipe, the smaller orifices 215 feed the channel (e.g., channel 220) formed by the tubular pipe.

In addition to the primary channel 220-*a* which is supplied by primary orifice 215-*a*, the elongated frame member 205-*d* includes a secondary channel 220-*b* that extends along a lateral axis of the elongated frame member 205-*d*, so as to correspond to the primary channel (e.g., channel 220) of the laterally aligned elongated frame member 205-*c*. The secondary channel 220-*b* is supplied by and is otherwise accessible for tensioned cables through secondary orifice 215-*b*. Additionally, the elongated frame member 205-*d* also includes a tertiary channel 220-*c* that extends along a vertical axis of the elongated frame member 205-*d*, so as to correspond to the primary channel (e.g., channel 220) of the vertically aligned elongated frame member 205-*h*. The tertiary channel 220-*c* is supplied by and is otherwise accessible for tensioned cables through tertiary orifice 215-*c*. It is appreciated that if each of the vertex 210-*a*-*h* include multiple channels (e.g., channels 220-*a*, 220-*b*, 220-*c*), then the modular building unit 105-*h* may be universally combined in any of a lateral, longitudinal, or vertical combination using the tensioned cable techniques described herein.

Although, only one of the elongated frame members 205 (i.e., elongated frame member 205-*d*) is shown as having a multiple channels 220, it is understood that one or more of the other elongated frame members may include one or more channels. For example, one, some, or all of the elongated frame members 205-*a*-*l* may include multiple channels (e.g., channel 220) so that the modular building unit 105-*g* may be combined with other modular building units 105 along each and any of a lateral axis, a longitudinal axis, and a vertical axis of the modular building unit 105-*h* using tensioned cables as described herein.

Figure 4:
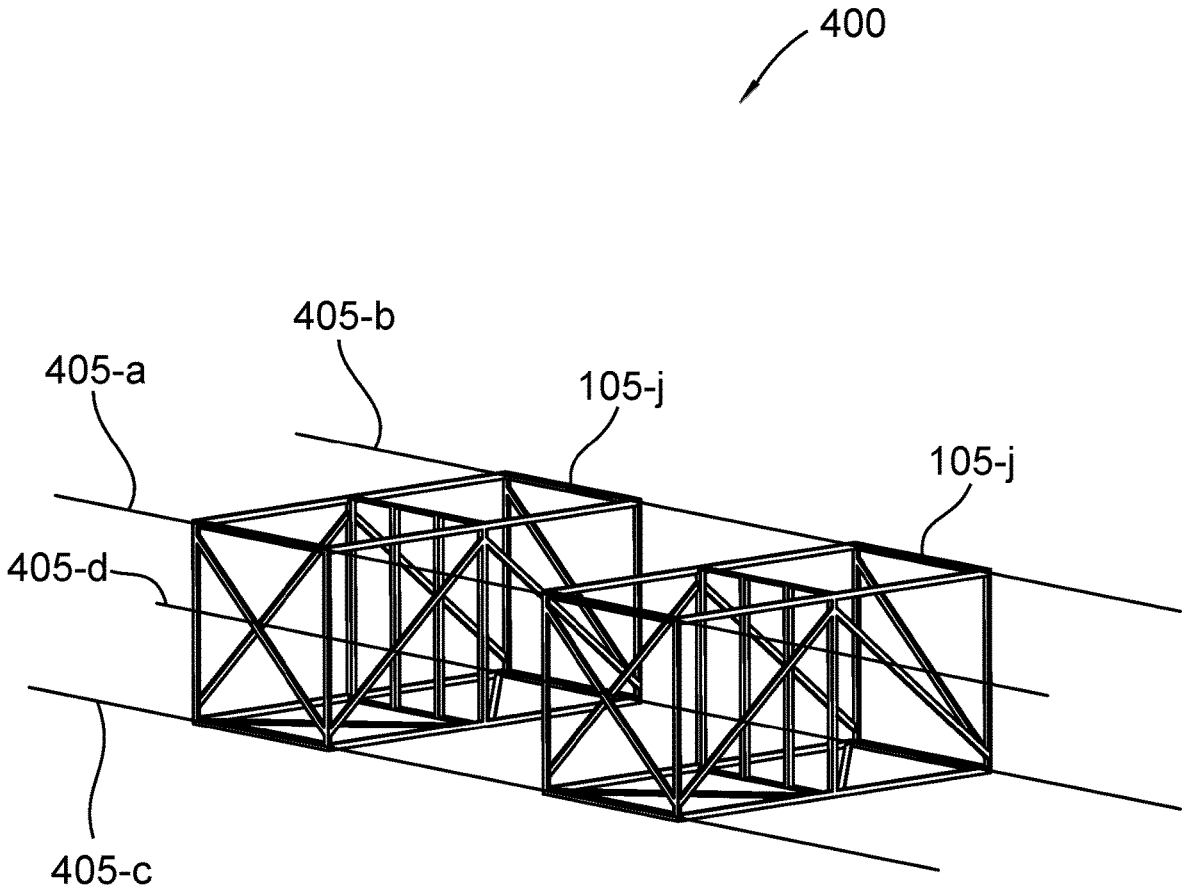
FIG. 4 is a perspective diagram illustrating an example of how modular building units may be positioned to construct a unified structure.

FIG. 4 is a perspective diagram illustrating an example of how modular building units 105-*j* may be positioned to construct a unified structure 400. Modular building units 105-*j* may be examples of any of the modular building units 105 discussed previously. For example, modular building units 105-*j* may be examples of modular building units 105-*g* with a single channel that extends along the longitudinal axis of the elongated frame member 205 or may be examples of modular building units 105-*h* with multiple channels in the elongated frame member 205 as discussed previously.

The at least two modular building units 105-*j* may be positioned so that a channel of each of the modular building units 105-*j* is aligned. Regardless of the position or orientation of the modular building units 105-*j*, as long as each of the modular building units 105-*j* has at least one channel that aligns with the other modular building units 105-*j*, then the modular building unit 105-*j* may be joined together with the other modular building unit(s) 105-*j*.

With the modular building units 105-*j* aligned into position, one or more cables may be passed through, threaded, or otherwise placed through each of the aligned channels along a line corresponding to a line between two vertex of each modular building unit 105-*j*. For example, cables 405-*a*, 405-*b*, 405-*c*, and 405-*d* are placed through aligning channels on the respective corners of the modular building units 105-*j*. Cables 405-*a*-*d* may be made of any suitable material. In some embodiments, the cables 405-*a*-*d* may be stranded metal cables.

To help illustrate the principle, the modular building units 105-*j* are shown spaced apart from each other as the cables 405 are passed through the modular building units 105-*j*. It is understood, that the modular building units 105-*j* are preferably positioned adjacent and abutting with each other so that a cable 405 may be passed directly across through the respective orifices 215 (which may act as guides as the cable 405 is passed through, for example).

Figure 5:
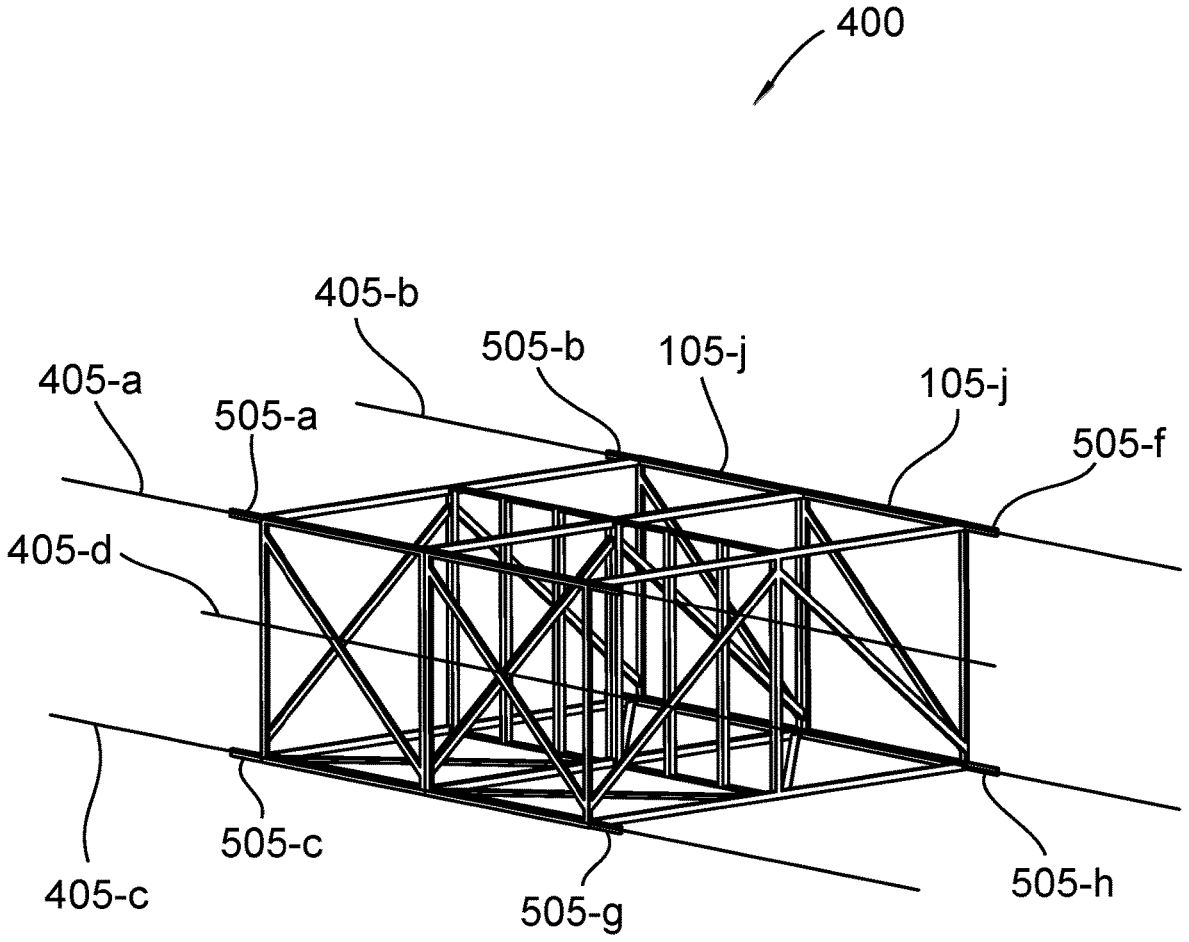
FIG. 5 is a perspective diagram illustrating an example of how modular building units, as discussed with respect to FIG. 4, may be tensioned together to form the unified structure.

FIG. 5 is a perspective diagram illustrating an example of how modular building units 105-*j*, as discussed with respect to FIG. 4, may be tensioned together to form the unified structure 400. The cables 405-*a*-*d* may be tensioned and held under tension by tensioners 505-*a*-*h*. The tensioners 505-*a*-*h* induce a compression force on the modular building units 105-*j* so that the modular building units 105-*j* are tensioned together (e.g., friction coupled together) so that the modular building units 105-*j* are immovable with respect to each other, thus forming the unified structure 400. In some embodiments, the tensioners 505-*a*-*h* are external to the modular building units 105-*j* so that they are visible as shown. In other embodiments, the tensioners 505-*a*-*h* may be recessed and/or installed completely within a respective channel so that they do not extend outside the border formed by the end modular building units 105-*j*.

While only two modular building units 105-*j* are shown, it is understood that multiple modular building units 105-*j* of various sizes or configurations may be placed between and within the two end modular building units 105-*j* (the modular building units 105-*j* that directly interface with the tensioners 505, for example). As shown, the use of four cables 405-*a*-*d* and eight tensioners 505-*a*-*h* may be used to create a unified structure 400 of two modular building units 105-*j* or may be used to create a unified structure of many modular building units 105 as illustrated in FIG. 1.

Figure 6:
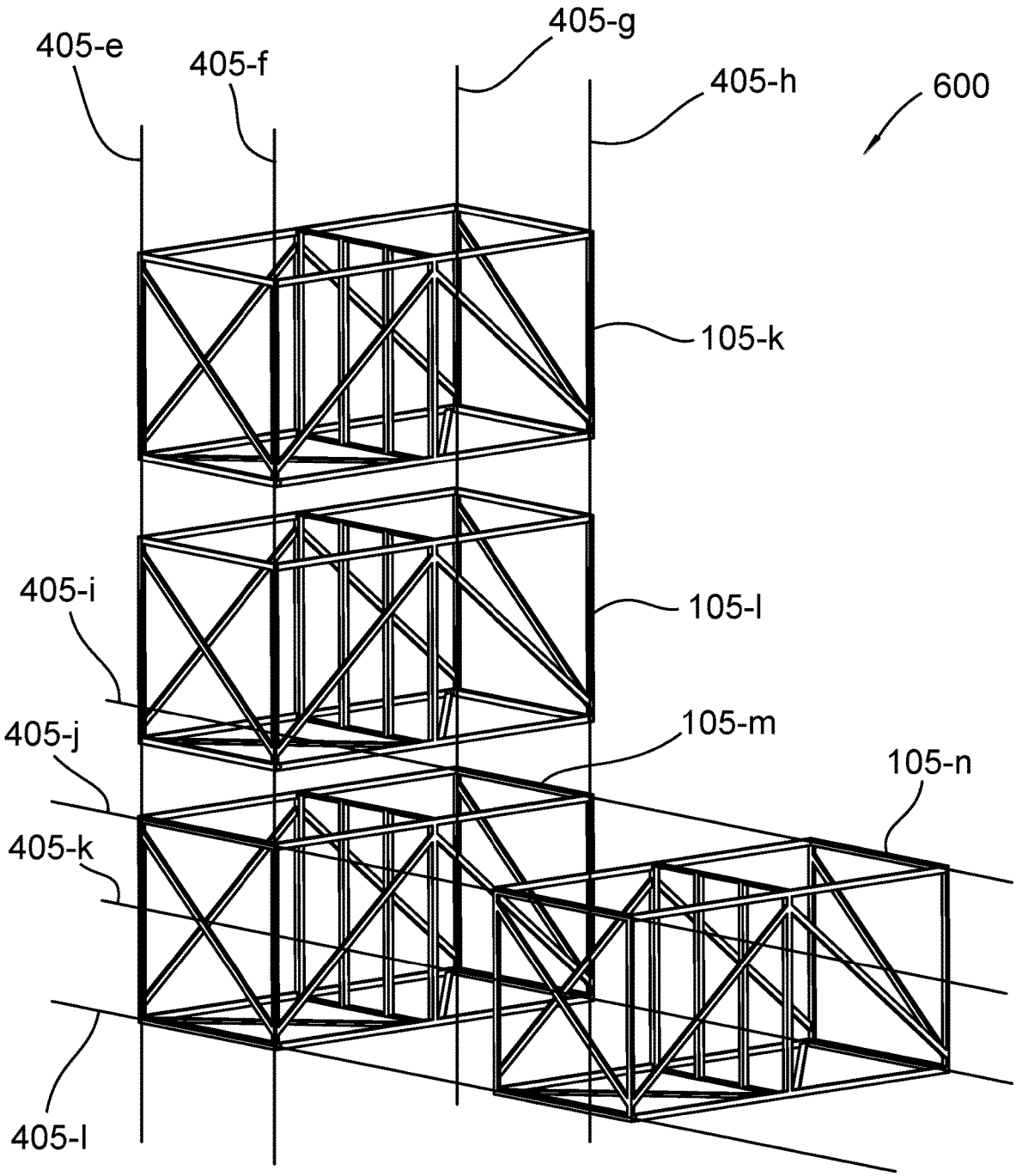
FIG. 6 is a perspective diagram illustrating an example of how modular building units may be combined in multiple directions to form complex unified structures.

FIG. 6 is a perspective diagram illustrating an example of how modular building units 105 may be combined in multiple directions to form complex unified structures 600. As shown, modular building units 105-*k*-*m* may be joined together in the vertical dimension via cables 405-*e*-*h* and modular building units 105-*m*-*n* may be joined together in the lateral dimension via cables 405-*i*-*k* by tensioning the cables as described herein. It is appreciated that modular building unit 105-*m* may be a universal modular building unit (e.g., modular unit 105-*h*, that includes multiple channels in an elongated frame member 205, for example) while the other modular building units may be examples of modular building unit 105-*g* or examples of modular building unit 105-*h*.

Figure 7:
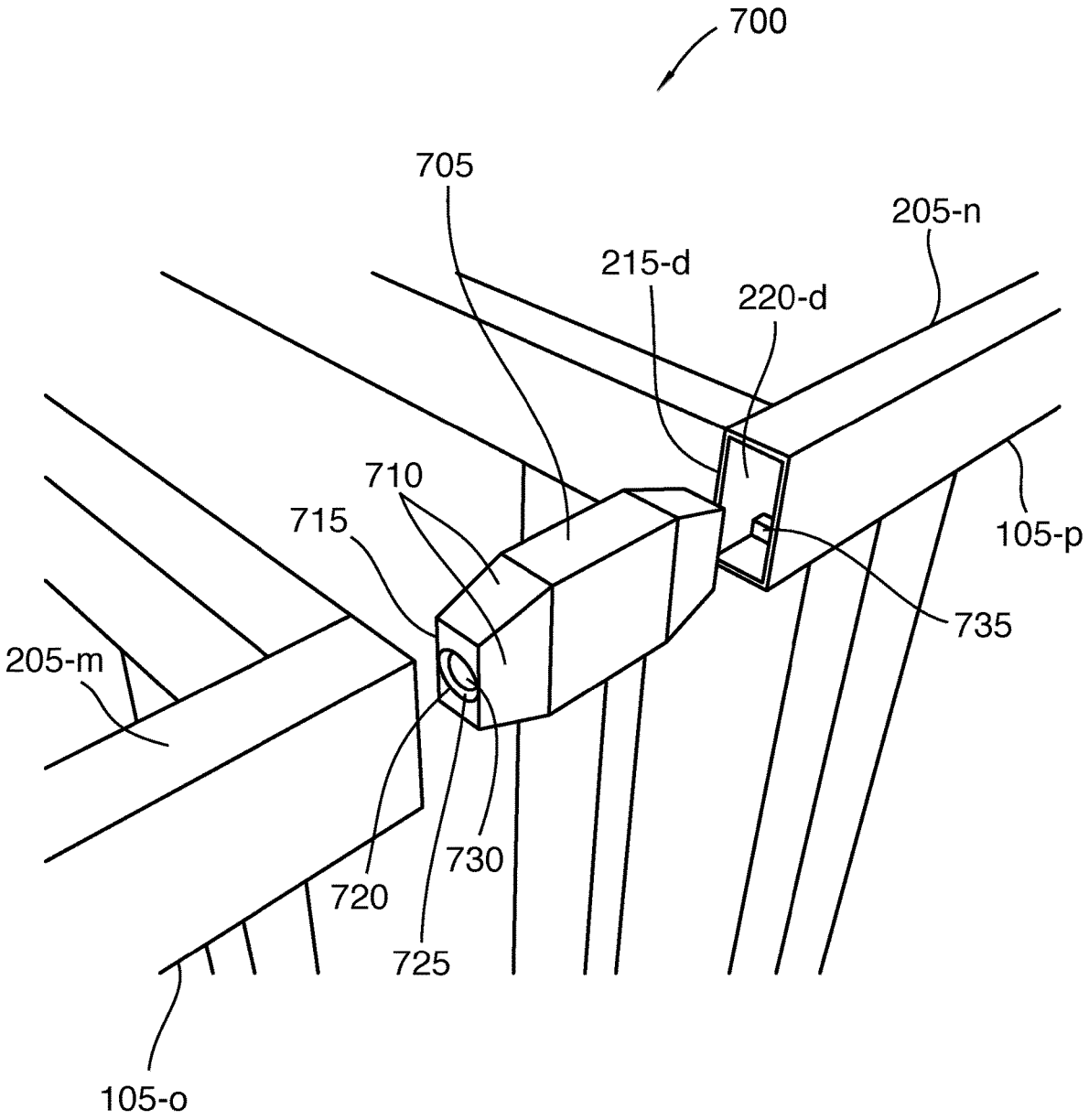
FIG. 7 is a perspective diagram illustrating a spanner that may be used to align and or support the connection between two adjacent modular building units

FIG. 7 is a perspective diagram illustrating a spanner 705 that may be used to align and or support the connection 700 between two adjacent modular building units 105-*o*, 105-*p*. The spanner 705 may be substantially the same size as the orifice and/or channel (e.g., orifice 215-*d* and/or channel 220-*d*) so that the spanner 705 may fit within the orifice and/or channel. The spanner 705 may be adapted to fit within the orifice and/or channel of both modular building units 105-*o*, 105-*p* so that the spanner 705 acts as a bridge and an extra support across the transition (e.g., channel transition from elongated frame member 205-*m* to elongated frame member 205-*n*) from one modular building unit 105 to another (e.g., modular building unit 105-*o* to modular building unit 105-*p*).

The spanner 705 may include a tapered portion 710 approaching each end 715 of the spanner 705, to enable easy insertion and alignment within an elongated frame member 205. For example, the tapered portion 710 may allow for easy insertion while ensuring that the mid portion of the spanner 705 has good contact with the channel walls (e.g., channel 220-*d*). Thus, the mid portion provides structural reinforcement and alignment when inserted. It is anticipated that substantially half of the spanner 705 is inserted into each elongated frame member 205 (e.g., elongated frame members 205-*m*, 205-*n*). In this manner, the modular building units 105-*o*, 105-*p* may flush against each other while the spanner 705 provides alignment and enhanced structural integrity from within the channel 220 in the elongated frame members 205-*m*, 205-*n*.

To prevent the spanner 705 from sliding too far into the channel 220, either the channel 220 or the spanner 705 may be configured with a stop member 735 that prevents over insertion. As shown in FIG. 7, the stop member 735 may protrude partly into the channel 220 so as to stop the spanner 705 from being inserted further into the channel 220. Although, not shown, it is understood that a stop member 735 may additionally or alternatively be positioned approximately in the middle of the spanner 705 itself, and to protrude so as to provide an interference fit with the orifice 215 (e.g., orifice 215-*d*).

The spanner 705 may include a spanner channel that extends through the spanner 705 so that a cable may be passed through the spanner. Although, only a single channel 730 along the longitudinal axis of the spanner 705 is shown, it is understood that the spanner 705 may include additional channels (e.g., lateral and/or vertical channels) so as to accommodate the universal modular building unit (e.g., modular building unit 105-*h*), for example.

In some embodiments, the orifice 720 may be larger than the size of the channel 730, with a transition zone 725 that tapers from the orifice 720 to the spanner channel 730. The larger orifice 720 and transition zone 725 may allow for fast cable insertion/pulling through the spanner channel 730. In some embodiments, a spanner 705 may be included in corresponding channels on each corner of the modular building unit 105. Although the spanner 705 is adapted to pass a cable through the spanner 705 (through the spanner channel 730, for example), it is understood that the spanner 705 may be used with or without a cable.

In some embodiments, the spanner 705 may act as a pin for aligning vertically arranged modular building units together. In some cases, spanners 705 in combination with gravity is sufficient to ensure that vertically arranged modular building units stay together (even without tension cables configured in the vertical axis, for example).

Figure 8:
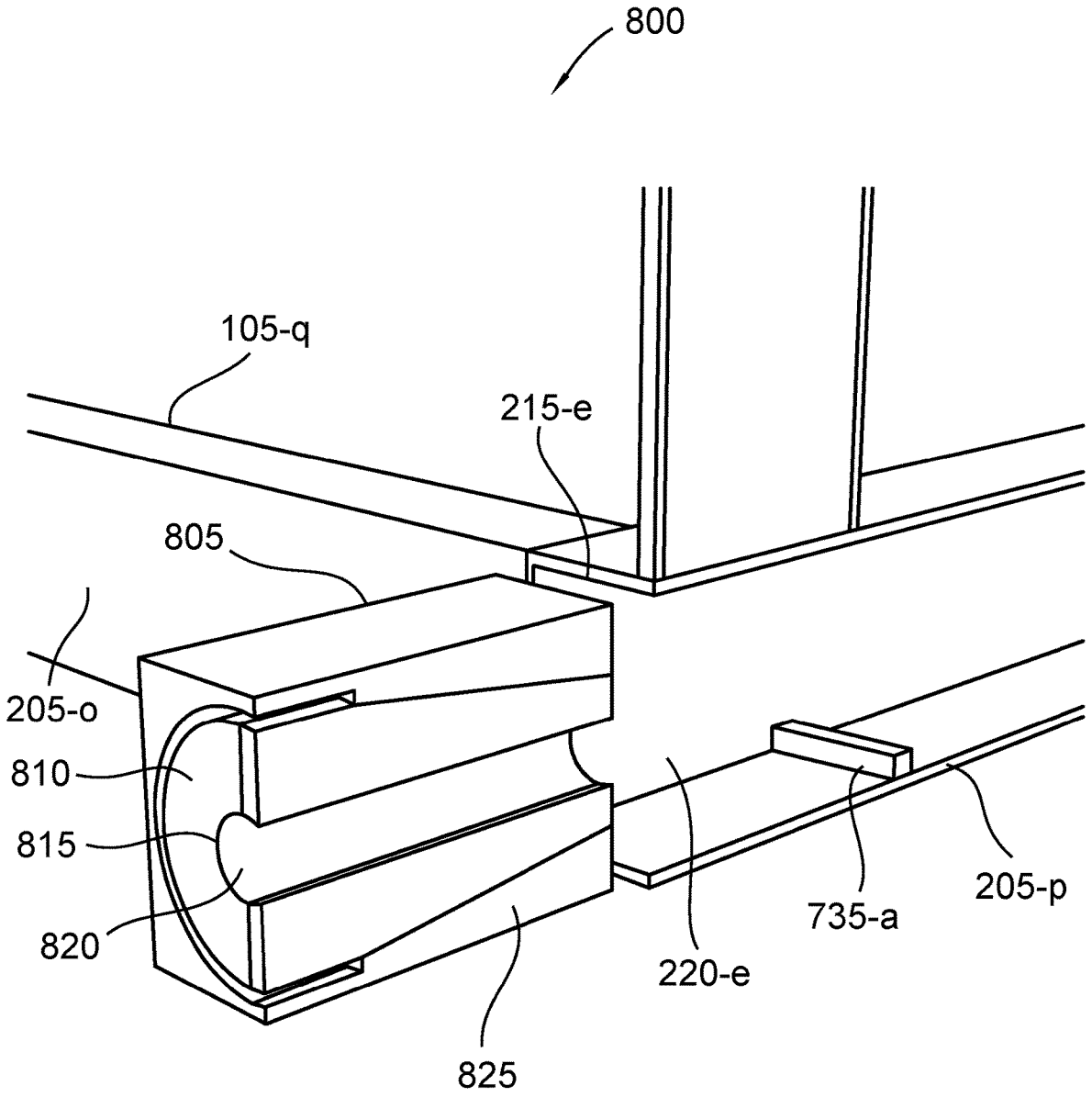
FIG. 8 is a cut-away perspective diagram of a tensioner that may be used to tension the cable that passes through a channel.

FIG. 8 is a cut-away perspective diagram 800 of a tensioner 805 that may be used to tension the cable that passes through a channel (e.g., channel 220-*e*). As shown, the tensioner 805 is approximately cut in half so that the inner structure of the tensioner 805 may be illustrated. The tensioner 805 may be an example of the tensioners 505 discussed with respect to FIG. 5.

As noted previously, the tensioner 805 may abut the channel 220-*e* but may be bigger than the orifice 215-*e* so that the tensioner 805 cannot enter the orifice 215-3. Alternatively, the tensioner 805 may fit within the orifice 215-*e* and may slide within the channel 220-*e*. In some cases, the tensioner 805 may be affixed to the channel 220-*e*. For example, the tensioner 805 may be welded to the channel 220-*e* and/or to the elongated frame member 205-*p*. In some embodiments, the tensioner may be held in place by a stop member 735-*a* (and the tension of the tensioned cable which holds the tensioner tightly against the stop member 735-*a*, for example). In some cases, the stop member 735-*a* may have a dual purpose for limiting the ingress of the spanner 705 and for limiting the ingress of the tensioner 805.

In some embodiments, the stop member 735-*a* may be positioned in the range of 0.75 inches to 6 inches from one of the orifices. In some embodiments, the stop member 735-*a* may be positioned in the range of 1 inch to 3 inches from one of the orifices. It yet another embodiment, the stop member 735-*a* may be positioned in the range of 1.5 inches and 2.5 inches. Although the stop member 735-*a* is only shown on one end of the elongated frame member 205, it is appreciated that each end of the elongated frame member 205 that includes a channel may include a stop member 735-*a* as described herein.

The tensioner 805 may include a collar 825 and a wedge 810. The collar 825 may have an outside surface that is shaped to match the channel 220-*e*. The collar 825 may be sized to be smaller than the orifice 215-*e* but to be substantially the same size as the internal dimensions of the channel 220-*e*. The collar 825 may have a conical shaped recess within the middle for receiving a wedge 810. The wedge 810 is removable from the collar 825. The wedge 810 includes a tensioning channel 820 that forms a tensioning channel orifice 815. The wedge 810 may be adjustable and expandable/contractible so that tensioning channel orifice 815 remains the same size but the opposite end of the wedge 810 may vary in diameter, such that the opposite end of the wedge 810 may be larger than the tensioning channel orifice 815 when the wedge 810 is not seated within the collar 825 and the opposite end of the wedge 810 may be smaller than the tensioning channel orifice 815 (the tensioning channel reduces in size to clamp tightly upon the cable, for example) when the wedge 810 is seated within the collar 825. It is appreciated that the conical shaped recess within the collar 825 may enforce the compression of the wedge 810 upon the cable (not shown), such that the harder the cable is tensioned, the stronger the wedge 810 compresses around the cable to ensure that the cable tension is maintained.

Figure 9:
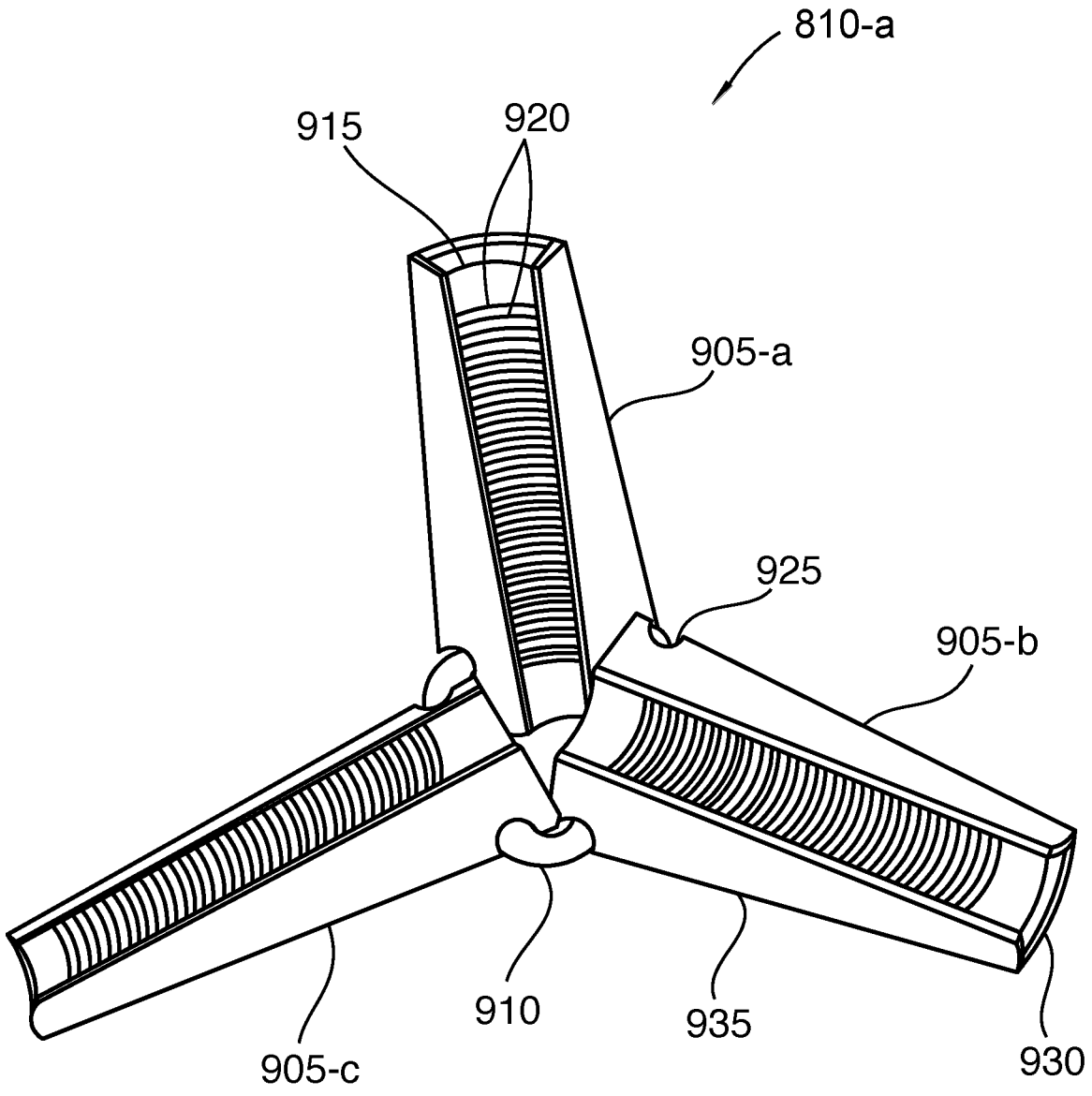
FIG. 9 is perspective diagram that illustrates one example of a wedge that may be used within the tensioner.

FIG. 9 is perspective diagram that illustrates one example of a wedge 810-*a* that may be used within the tensioner 805. As shown the tensioner may include different portions (e.g., portions 905-*a*, 905-*b*, and 905-*c*) that provide a consistent orifice (e.g., orifice 815) at one end but be expandable and contractible at the opposite end. In some embodiments, the different portions (e.g., portions 905-*a*, 905-*b*, and 905-*c*) may each be wedge shaped and which together may also be collectively wedge shaped. The consistent orifice (e.g., orifice 815) may be defined by the articulating mechanism 910 that enable the different portions (e.g., 905-*a*, 905-*b*, and 905-*c*) to articulate. In one example, the articulating mechanism 910 may be a ring (e.g., triangular shaped ring) and the different portions may include hole 925 for receiving the articulating mechanism 910.

In some embodiments, the internal surface of the different portions (the internal surface that forms the tensioning channel 820, for example) may include striations (e.g., ridges, wedge shaped ridges, teeth, etc.) to improve the hold of the wedge 810-*a* on the cable. It is appreciated that the cable may easily pass through the wedge 810-*a* when the wedge 810-*a* is in an expanded state as shown, but that the cable cannot pass through the wedge 810-*a* when the wedge is contracted around the cable and the conical shape of the collar 825 is enforcing a constricted diameter around the cable (as the wedge 810 is tensioned into a seated position within the collar 825, for example). In some cases, the tensioner 805, due to is clever design, may hold a tensioned cable within a modular building unit 105 under constant tension indefinitely.

Thus, using the disclosed techniques, complex structures may be quickly and cost effectively built using a combination of modular building units and tensioned cables. The strength and structural integrity associated with these building techniques is also improved over traditional building techniques because of the unity provided by a single unified structure.

Figure 10:
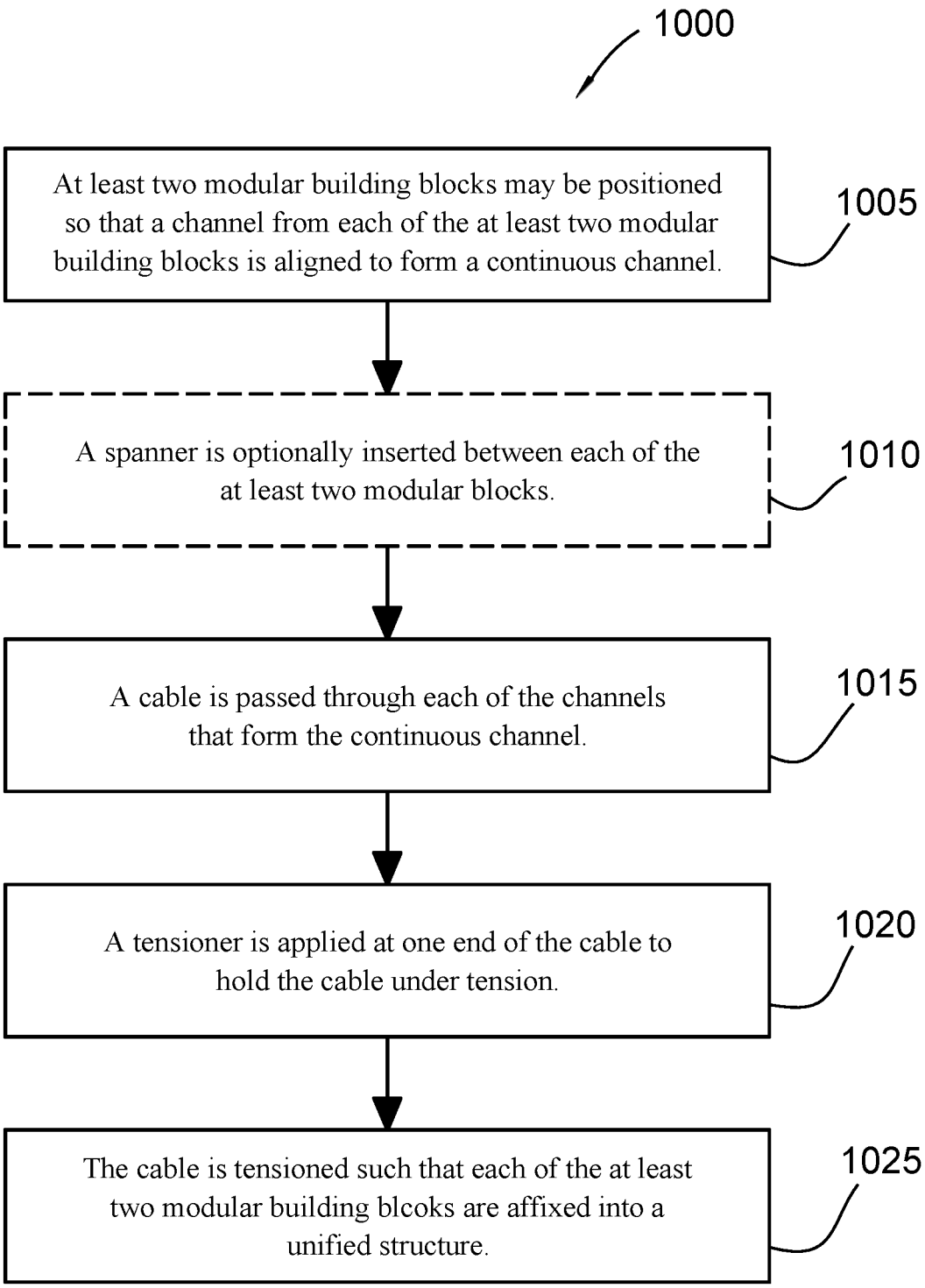
FIG. 10 is a flow diagram illustrating a method for constructing unified structure using modular building units and tensioned cables.

FIG. 10 is a flow diagram illustrating a method 1000 for constructing unified structure using modular building units and tensioned cables. In some cases, construction techniques may be automated and the method 1000 may be implemented by an application specific processor or a general processor that becomes an application specific processor as a result of the instruction set provided to the general processor.

At step 1005, at least two modular building blocks may be positioned so that a channel from each of the at least two modular building blocks is aligned to form a continuous channel.

At step 1010, a spanner is optionally inserted between each of the at least two modular building blocks.

At step 1015, a cable is passed through each of the channels that form the continuous channel.

At step 1020, a tensioner is applied at one end of the cable to hold the cable under tension.

At step 1025, the cable is tensioned such that each of the at least two modular building blocks are affixed into a unified structure.

The invention has been described with reference to various specific and preferred embodiments and techniques. Nevertheless, it is understood that many variations and modifications may be made while remaining within the spirit and scope of the invention.

What is claimed is:

1. A modular building unit, comprising:

at least nine elongated frame members, each elongated frame member having two opposing distal ends, wherein each elongated frame member forms one edge of a prism, wherein the prism has two end faces and at least three side faces, and wherein each distal end of each elongated frame member is rigidly attached to a distal end of two other elongated frame members of the at least nine elongated frame members;

wherein at least three elongated frame members of the at least nine elongated frame members are parallel, wherein each of the at least three elongated frame members comprises a channel running therethrough, wherein each channel is open at both distal ends of the respective elongated frame member of the at least three elongated frame members and is adapted to receive a tensioning cable therethrough;

whereby the edges of each end face of the prism are configured to abut edges of a face of a like modular building unit, and whereby like modular building units can be held together at adjoining end faces by tensioning cables.

2. The modular building unit of claim 1, wherein the at least nine elongated frame members comprise twelve elongated frame members, wherein the prism is a rectangular prism, with the two end faces and the at least three side faces comprising four side faces, wherein four elongated frame members of the twelve elongated frame members are parallel, and wherein each of the four elongated frame members comprises a channel running therethrough.

3. The modular building unit of claim 1, wherein the at least nine elongated frame members comprise eighteen elongated frame members, wherein the prism is a hexagonal prism, with the two end faces and the at least three side faces comprising six side faces.

4. The modular building unit of claim 2, wherein at least two of the elongated frame members which are orthogonal to the four elongated frame members, also comprise a channel running therethrough, wherein each channel is open at both distal ends of the respective elongated frame member of the at least two of the elongated frame members and is adapted to receiving a tensioning cable therethrough, whereby the edges of each side face of the prism are configured to abut edges of a face of a like modular building unit, and whereby like modular building units can be held together at one or more of the end faces and one or two of the side faces by tensioning cables running through the respective channels.

5. The modular building unit of claim 2, wherein all of the twelve elongated frame members comprise a channel running therethrough, wherein each channel is open at both distal ends of the respective elongated frame member of the twelve elongated frame members and is adapted to receive a tensioning cable therethrough, whereby the edges of each face of the rectangular prism are configured to abut edges of a face of a like modular building unit, and whereby like modular building units can be held together at one or more of the end faces and one or more of the side faces by tensioning cables running through the respective channels.

6. The modular building unit of claim 1, wherein each of the at least three elongated frame members is adapted to receive a spanning member within each distal end, wherein a portion of the spanning member is adapted to be received within any of the channels in the modular building unit and another portion of the spanning member is adapted to be received within a channel of an adjacent modular building unit.

7. The modular building unit of claim 6, wherein each channel comprises a stop member protruding from an interior surface of the channel, wherein the stop member prevents the spanning member from being inserted too deeply into the channel.

8. A modular building system, comprising:

a first building unit comprising at least nine elongated frame members, each elongated frame member having two opposing distal ends, wherein each elongated frame member forms one edge of a prism, wherein the prism has two end faces and at least three side faces, wherein each distal end of each elongated frame member is rigidly attached to a distal end of two other elongated frame members of the at least nine elongated frame members, wherein at least three elongated frame members of the at least nine elongated frame members are parallel, wherein each of the at least three elongated frame members comprises a channel running therethrough, and wherein each channel is open at both distal ends of the elongated frame member;

a second building unit comprising at least nine elongated frame members, wherein each elongated frame member forms one edge of a prism, wherein the prism has two end faces and at least three side faces, wherein each end of each elongated frame member is rigidly attached to a distal end of two other elongated frame members of the at least nine elongated frame members of the second building unit, wherein at least three elongated frame members of the at least nine elongated frame members of the second building unit are parallel, wherein each of the at least three elongated frame members comprises a channel running therethrough, and wherein each channel is open at both distal ends of a respective elongated frame member of the at least three elongated frame members;

wherein the edges of one end face of the two end faces of the first building unit abuts the edges of one end face of the two end faces of the second building unit, thereby aligning the channels of the first building unit with the channels of the second building unit;

at least three cables, wherein each cable of the at least three cables has first and second distal ends; and wherein each cable passes through one of the channels of the first building unit and through the aligned channel of the second building unit;

first keepers coupled to the first distal end of each cable; and second keepers coupled to the second distal end of each cable;

wherein the first keepers and the second keepers are adapted to tension each cable such that the first building unit and the second building unit are joined together to form a rigid structure.

9. The modular building system of claim 8, wherein the at least nine elongated frame members of the first and second building units each comprise twelve elongated frame members, wherein the prism of each of the first and second building units is a rectangular prism, and wherein the at least three elongated frame members of each of the first and second building units comprise four elongated frame members, and wherein each of the four elongated frame members of the first and second building units comprise a channel running therethrough.

10. The modular building system of claim 8, further comprising:

a third building unit comprising at least nine elongated frame members, each elongated frame member having two opposing distal ends, wherein each elongated frame member forms one edge of a prism, wherein the prism has two end faces and at least three side faces, wherein each distal end of each elongated frame member is rigidly attached to a distal end of two other elongated frame members of the at least nine elongated frame members of the third building unit, wherein at least three elongated frame members of the at least nine elongated frame members of the third building unit are parallel, wherein each of the at least three elongated frame members comprises a channel running therethrough, and wherein each channel is open at both distal ends of the respective elongated frame member of the at least three elongated frame members;

wherein the edges of one end face of the two end faces of the third building unit abuts the edges of an end face of the two end faces of the second building unit, thereby aligning the channels of the third building unit with the channels of the second building unit and the channels of the first building unit, and wherein the at least three cables pass through channels in the first building unit, the second building unit, and the third building unit and, when tensioned by the first keepers and the second keepers, the first building unit, the second building unit, and the third building unit are joined together to form a rigid structure.

11. The modular building system of claim 10, wherein the at least nine elongated frame members of each of the first building unit, the second building unit, and the third building unit each comprise twelve elongated frame members, wherein the prism of each of the first building unit, the second building unit, and the third building unit is a rectangular prism, and wherein each of the at least three elongated frame members of each of the first building unit, the second building unit, and the third building unit comprise four elongated frame members, and wherein each of the four elongated frame members of the first building unit, the second building unit, and the third building unit comprise a channel running therethrough.

12. The modular building system of claim 8, further comprising at least three spanning members, wherein each spanning member of the at least three spanning members is inserted into adjoining distal ends of aligned channels.

13. The modular building system of claim 12, wherein each channel comprises a stop member protruding from an interior surface of the channel to prevent a spanning member of the at least three spanning members from being inserted too deeply into the channel.

14. The modular building system of claim 12, wherein each spanning member of the at least three spanning members comprises a stop member protruding from an outer surface of the spanning member, wherein the stop member prevents the spanning member from being inserted too deeply into a channel.

15. The modular building system of claim 12, wherein each spanning member of the at least three spanning members comprises a channel that connects adjoining channels for a cable to pass through.

16. A modular building system, comprising:

a plurality of building units, wherein each building unit in the plurality of building units comprises twelve elongated frame members, each elongated frame member having two opposing distal ends, wherein each elongated frame member forms one edge of a rectangular prism, wherein the rectangular prism has six faces, wherein each distal end of each elongated frame member is rigidly attached to a distal end of two other elongated frame members of the twelve elongated frame members of a respective building unit of the plurality of building units, wherein all of the twelve elongated frame members of a respective unit of the plurality of building units comprise a channel running therethrough, and wherein each channel is open at both distal ends of the respective elongated frame member of the twelve elongated frame members;

a plurality of cables, wherein each cable in the plurality of cables includes a first keeper and a second keeper;

wherein the plurality of building units can be rigidly joined together by abutting the edges of at least one face of each of the plurality of building units together, aligning respective channels associated with the abutting faces of the plurality of building units, passing cables through the respective aligned channels and pulling a tension on the cables via the respective first and second keepers to thereby press the abutting edges of the faces together.

17. The modular building system of claim 16, wherein a first and second building unit of the plurality of building units are rigidly joined together in a first direction and wherein at least a third building unit of the plurality of building units is rigidly joined to the first building unit in a second direction that is orthogonal to the first direction.

18. The modular building system of claim 17, wherein at least a fourth building unit of the plurality of building units is rigidly joined to the first building unit in a third direction that is orthogonal to the first and second direction.

19. The modular building system of claim 16, further comprising a plurality of spanning members, wherein each of the plurality of spanning members is inserted into abutting ends of the aligned channels.

20. The modular building system of claim 19, wherein each spanning member in the plurality of spanning members comprises a channel for a cable to pass through.

* * * * *